US006100785A

United States Patent [19]

Kato et al.

[11] Patent Number: 6,100,785

[45] **Date of Patent: *Aug. 8, 2000**

[54] VOLTAGE NONLINEAR RESISTOR AND LIGHTNING ARRESTER

[75] Inventors: Tomoaki Kato; Yoshio Takada; Kei-ichiro Kobayashi; Akio Hori; Osamu Wada; Masahiro Kobayashi; Naomi Furuse; Shinji Ishibe; Mitsunori Hama; Shoichi Shichimiya, all of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/937,608

[22] Filed: Sep. 25, 1997

[30] Foreign Application Priority Data

Mar. 21, 1997 [JP] Japan ..... 9-068312

[51] Int. Cl.[7] ..... H01C 7/10

[52] U.S. Cl. ..... 338/20; 338/21

[58] Field of Search ..... 338/20, 21, 330; 252/519.54

[56] References Cited

U.S. PATENT DOCUMENTS

| | | | |
|---|---|---|---|
| 4,730,179 | 3/1988 | Nakata et al. | 338/20 |
| 4,736,183 | 4/1988 | Yamazaki et al. | 338/20 |
| 4,855,708 | 8/1989 | Nakata et al. | 338/20 |
| 4,933,659 | 6/1990 | Imai et al. | 338/20 |
| 5,138,298 | 8/1992 | Shino | 338/21 |
| 5,592,140 | 1/1997 | Tokunaga et al. | 338/21 |
| 5,610,570 | 3/1997 | Yamada et al. | 338/20 |
| 5,640,136 | 6/1997 | Yodogawa et al. | 338/20 |
| 5,739,742 | 4/1998 | Iga et al. | 338/21 |

FOREIGN PATENT DOCUMENTS

| | | |
|---|---|---|
| A-0667626 | 8/1995 | European Pat. Off. . |
| 0762438 | 3/1997 | European Pat. Off. . |

OTHER PUBLICATIONS

Patent Abstracts of Japan, vol. 096, No. 009, Sep. 30, 1996 & JP–08 115805, May 7, 1996.

Patent Abstracts of Japan, vol. 095, No. 002, Mar. 31, 1995 & JP–06 321617, Nov. 22, 1994.

Brankovic Z et al, "Nanostructured Constituents of ZNO–Based Varistors Prepared by Mechanical Attrition-"Mar. 1, 1994, Nanostructured Materials, vol. 4, pp. 149–157.

*Primary Examiner*—Michael L. Gellner
*Assistant Examiner*—Richard K. Lee
*Attorney, Agent, or Firm*—Sughrue, Mion, Zinn, Macpeak & Seas, PLLC

[57] ABSTRACT

A voltage nonlinear resistor of a sintered substance of a composite consisting essentially of zinc oxide and containing at least one rare earth element and at least one additional rare earth element selected from the group consisting of Eu, Gd, Tb, Dy, Ho, Y, Er, Tm, Yb, and Lu, and Bi and Sb. Spacing $d_n$ (Å) provided from precipitation grains formed in zinc oxide grains or on a grain boundary lies in the range of 2.85 Å$\leqq d_1 \leqq$2.91 Å, 1.83 Å$\leqq d_2 \leqq$1.89 Å, 1.77 Å$\leqq d_3 \leqq$1.82 Å, 1.56 Å$\leqq d_4 \leqq$1.61 Å, 1.54 Å$\leqq d_5 \leqq$1.60 Å. The spacing mentioned here is a spacing obtained according to the Bragg condition in the X-ray diffraction method.

13 Claims, 9 Drawing Sheets

1: SPINEL PARTICLE
2: ZINC OXIDE PARTICLE
3: ZINC SILICATE PARTICLE
4: BISMUTH OXIDE
5: R-Bi-Sb-Zn-Mn-O COEXISTENCE OXIDE GRAIN
6: TWIN BOUNDARY

1: SPINEL PARTICLE
2: ZINC OXIDE PARTICLE
3: ZINC SILICATE PARTICLE
4: BISMUTH OXIDE
5: R-Bi-Sb-Zn-Mn-O COEXISTENCE OXIDE GRAIN
6: TWIN BOUNDARY

VOLTAGE NONLINEAR RESISTOR AND LIGHTNING ARRESTER

BACKGROUND OF THE INVENTION

1. Field of the Invention

This invention relates to a voltage nonlinear resistor which is made of a sintered substance consisting essentially of zinc oxide and can be used preferably for a lightning arrester, a surge absorber, etc., for example, and a lightning arrester having the voltage nonlinear resistor mounted thereon.

2.Description of the Prior Art

FIG. 10 is a schematic diagram to show the structure of a general zinc oxide varistor. Hitherto, a voltage nonlinear resistor consisting essentially of zinc oxide, used for a lightning arrester, etc., has been manufactured as follows. Compositions comprising additives effective for improvement of electric characteristics including bismuth oxide indispensable for development of voltage nonlinearity added to zinc oxide of an essential component are mixed, granulated, molded, and sintered to provide a sintered substance and electrodes made up of side face high resistance layer, metal aluminum, etc., are placed on the sintered substance.

FIG. 11 is a schematic diagram to show the microstructure of a part of the crystalline structure of a general voltage nonlinear resistor. Numeral 1 is a spinel grain consisting essentially of zinc and antimony, numeral 2 is a zinc oxide grain, numeral 3 is zinc silicate $Zn_2SiO_4$, numeral 4 is oxide bismuth, and numeral 6 is a twin boundary in a zinc oxide grain. That is, the spinel grains consisting essentially of zinc and antimony are classified into two types of those surrounded by the zinc oxide grains and those existing in the vicinity of the triple point (multiple point) of the zinc oxide grains, and a part of the bismuth oxide 4 exists not only at the multiple point, but also on the boundary of the zinc oxide grain 2.

An experiment using point electrodes reveals that the grains consisting essentially of zinc oxide serve simply as a resistor and show voltage nonlinearity on the boundary between the zinc oxide grains 2 and 2 (G. D. Mahan, L. M. Levinson & H. R. Philipp, "Theory of conduction in ZnO varistors," (J. Appl. Phys. 50[4], 2799 (1979), which will be hereinafter referred to as document 1. As described later, it is acknowledged by experiment that the number of boundaries between the zinc oxide grains 2 and 2 (grain boundaries) (T. K. Gupta, "Application of Zinc Oxide Varistors," J. Am. Ceram. Soc., 73[7]1817–1840 (1990), which will be hereinafter referred to as document 2.

FIG. 12 is a volt-ampere plot to show the voltage-current characteristic (nonlinear characteristic) of the general voltage nonlinear resistor having the crystalline structure. A zinc oxide family voltage nonlinear resistor having excellent protection performance has a small ratio between voltage $V_H$ in large current area H and voltage $V_L$ in small current area L, $V_H/V_L$ (discharge voltage ratio) in the figure. To discuss improvement in the discharge voltage ratio, factors determining the discharge voltage ratio in a large current area and that in a small current area differ, thus the discharge voltage ratios need to be discussed separately. Therefore, in the description that follows, voltage $V_S$ in S in the figure is used and the discharge voltage ratio in the large current area, $V_H/V_S$, and that in the small current area, $V_S/V_L$, will be discussed separately.

$V_H$ of the discharge voltage ratio in the large current area, $V_H/V_S$, is determined by electric resistivity in zinc oxide crystal grains (documents 1 and 2). The smaller the resistivity in zinc oxide crystal grains, the smaller $V_H$. Therefore, $V_H/V_S$ lessens. On the other hand, the discharge voltage ratio in the small current area, $V_S/V_L$ is determined by a Schottky barrier probably formed in the zinc oxide crystal grain boundary (documents 1 and 2). The larger the apparent resistivity of the zinc oxide crystal grain boundary, the smaller $V_S/V_L$. Therefore, to improve the discharge voltage ratio $V_H/V_L$, the electric resistivity in zinc oxide crystal grains needs to be reduced and the apparent electric resistivity of the zinc oxide crystal grain boundary needs to be raised.

In the voltage nonlinear resistor, $V_S$ shown in FIG. 12 represents a nonlinear threshold voltage. The $V_S$ value is set for a transmission system to which lightning arresters are applied. For $V_S$ interelectrode voltage across a device when the device is energized with 1 mA ($V_{1\ mA}$(V)) or the like is often used as a representative value. Considering the device size, the current value 1 mA corresponds to a current density of about 30–150 $\mu A/cm^2$. The $V_S$ value of a zinc oxide device is proportional to the thickness of the device.

With a lightning arrester used for high-voltage power transmission of, for example, UHV 100 million volts or the like, if devices of the same shape having a VS value equal to that of the conventional device are piled up, the number of series lamination layers increases. Resultantly, the lightning arrester becomes large and the series connection system becomes complicated, thus electric, thermal, and mechanical design problems increase. Therefore, if a device having a large VS value per unit length provided by dividing the $V_S$ value by the device thickness (for example, $V_{1\ mA/mm}$, called varistor voltage) can be used, the share voltage per device is raised, so that the number of series lamination layers of the device can be decreased and the problems can be solved.

The former study shows that the crystal grain diameter of the zinc oxide 2 in the crystalline structure of the device shown in FIG. 11 controls the $V_S$ value (document 2). A current area of about 1 mA is a nonlinear area in the volt-ampere plot shown in FIG. 12 and experimentally expression (1) holds.

$$V_{1\ mA/mm}=mm/D \tag{1}$$

where k is a constant and D is an average particle diameter of zinc oxide. Therefore, 1/D is equivalent to the number $N_g$ of the crystal grain boundary between zinc oxide grains existing per unit length and expression (1) can be rewritten as expression (2)

$$V_{1\ mA/mm}=k'N_g \tag{2}$$

It is seen that the constant k' represents a varistor voltage per grain boundary of the zinc oxide device (document 2).

In summary, to provide a compact lightning arrester having an excellent protection property, (a) the discharge voltage ratio ($V_H/V_L$) is small as the electric characteristic of a voltage nonlinear resistor and (b) the varistor voltage is increased as the electric characteristic required for a voltage nonlinear resistor necessary to provide a compact lightning arrester. It is strongly required that the discharge voltage ratio ($V_H/V_L$) is set to a small value by improving the composition and manufacturing process of the voltage nonlinear resistor because the factor for determining the protection property of the lightning arrester is (a) and that the varistor voltage is set to a large value because the factor for determining the structure such as the size of the lightning arrester is mainly (b).

SUMMARY OF THE INVENTION

It is therefore an object of the invention to provide a voltage nonlinear resistor with a high varistor voltage and a small discharge voltage ratio from a large current area to a small current area. It is another object of the invention to provide a lightning arrester having the voltage nonlinear resistor mounted thereon.

According to the first of the invention, there is provided a voltage nonlinear resistor of a sintered substance of a composite consisting essentially of zinc oxide and containing a plurality of rare earth elements, at least one of which is selected from the group consisting of Eu, Gd, Tb, Dy, Ho, Y, Er, Tm, Yb, and Lu, and Bi and Sb, wherein spacing $d_n$ (Å) provided from precipitation grains formed in zinc oxide grains or on a grain boundary lies in the range of 2.85 Å$\leqq d_1 \leqq$2.91 Å, 1.83 Å$\leqq d_2 \leqq$1.89 Å, 1.77 Å$\leqq d_3 \leqq$1.82 Å, 1.56 Å$\leqq d_4 \leqq$1.61 Å, 1.54 Å$\leqq d_5 \leqq$1.60 Å.

According to the second of the invention, there is provided a voltage nonlinear resistor of a sintered substance of a composite consisting essentially of zinc oxide and containing at least one rare earth element selected from the group consisting of Eu, Gd, Tb, Dy, Ho, Y, Er, Tm, Yb, and Lu, and Bi and Sb, wherein spacing $d_n$ (Å) provided from precipitation grains formed in zinc oxide grains or on a grain boundary lies in the range of 2.85 Å$\leqq d_1 \leqq$2.91 Å, 1.83 Å$\leqq d_2 \leqq$1.89 Å, 1.77 Å$\leqq d_3 \leqq$1.82 Å, 1.56 Å$\leqq d_4 \leqq$1.61 Å, 1.54 Å$\leqq d_5 \leqq$1.60 Å.

According to the third of the invention, there is provided a voltage nonlinear resistor of a sintered substance of a composite consisting essentially of zinc oxide and containing at least one rare earth element selected from the group consisting of Ho, Y, Er, and Yb, and Bi and Sb, wherein spacing $d_n$ (Å) provided from precipitation grains formed in zinc oxide grains or on a grain boundary lies in the range of 2.86 Å$\leqq d_1 \leqq$2.88 Å, 1.85 Å$\leqq d_2 \leqq$1.86 Å, 1.78 Å$\leqq d_3 \leqq$1.79 Å, 1.57 Å$\leqq d_4 \leqq$1.58 Å, 1.55 Å$\leqq d_5 \leqq$1.56 Å.

The spacing is measured by an X-ray diffraction method at a room temperature.

A lightning arrester according to the invention comprises a voltage nonlinear resistor of the invention mounted thereon.

Preferably, zinc oxide of a main component according to the invention is adjusted so that it is contained in a raw material 90–97 mol %, especially 92–96 mol % in terms of ZnO from the viewpoint of improvement in varistor voltage and voltage nonlinearity.

If at least one or more of rare earth elements of Eu, Gd, Tb, Dy, Ho, Y, Er, Tm, Yb, and Lu are added to a voltage nonlinear resistor of the invention, precipitation grains are formed in ZnO grains or on a grain boundary and the large current area discharge voltage ratio is lessened and at the same time, the varistor voltage can be increased. FIG. 1 is a schematic diagram to show the crystalline structure of an device provided by adding the rare earth elements. As shown here, it contains precipitation grains containing added rare earth elements (R)-bismuth-antimony-zinc-manganese in addition to ZnO crystal and a spinel phase consisting essentially of zinc and antimony. When the grains are formed, grain growth of ZnO is suppressed, so that the large current area discharge voltage ratio is lessened and the varistor voltage can be increased at the same time.

Spacing obtained from the precipitation grains, dn (Å) (n=1–5 where n denotes a number given in the descending order of values of spacings obtained from the precipitation grains), lies in the range of 2.85 Å$\leqq d_1$2.91 Å, 1.83 Å$\leqq d_2 \leqq$1.89 Å, 1.77 Å$\leqq d_3 \leqq$1.82 Å, 1.56 Å$\leqq d_4 \leqq$1.61 Å, 1.54 Å$\leqq d_5 \leqq$1.60 Å. The spacing mentioned here is a spacing obtained according to a Bragg condition in an X-ray diffraction method. The Bragg condition is represented by $$2d \cdot \sin\theta = N \cdot \lambda \quad (3)$$

where d is a spacing, θ is an angle which incident X ray and diffraction X ray form with a crystal lattice face, N is a diffraction order (positive integer; 1 is used here), and k is X-ray length.

Therefore, the spacing d can be obtained as $$d = (N \cdot \lambda)/(2 \sin\theta) \quad (4)$$

by solving expression (3) for d.

One element of Eu, Gd, Tb, Dy, Ho, Y, Er, Tm, Yb, and Lu is made indispensable and at least one of other rare earth elements may be added. Since every rare earth element has an ionic radius larger than the ionic radius of $Zn^{2+}$, the rare earth element are hard to be replaced to Zn sites in ZnO grains and are segregated as independent crystal grains mainly taken into the crystal grain boundary of ZnO or ZnO crystal. If an extremely small part of the crystal grains is dissolved solidly in the ZnO crystal grains, the inside of the crystal grains of ZnO is put into low resistance owing to the electronic effect. Resultantly, the large current area discharge voltage ratio can be lessened. That is, other rare earth elements than those mentioned above do not form precipitation grains and therefore cannot much raise the varistor voltage, but can lessen the large current area discharge voltage ratio as compared with a resistor to which no rare earth elements are added. Then, in a case where the varistor voltage need not much be raised, the rare elements having the effect of lessening the large current area discharge voltage ratio and having a small effect of raising the varistor voltage, such as La, Ce, pr, Nd, and Sm, and small amounts of Eu, Gd, Tb, Dy, Ho, Y, Er, Tm, Yb, and Lu are added in combination, thereby providing a device with a small large current area discharge voltage ratio while increasing the varistor voltage a little. Also in such a case, the added Eu, Gd, Tb, Dy, Ho, Y, Er, Tm, Yb, and Lu elements form precipitation grains.

If the rare earth elements added to the voltage nonlinear resistor of the invention are limited to at least one element of Ho, Y, Er, and Yb, a device with a large varistor voltage and a small large current area discharge voltage ratio minimizing deterioration of the small current area discharge voltage ratio can be provided. A device to which the rare earth elements Eu, Gd, Tb, Dy, Ho, Y, Er, Tm, Yb, and Lu are added can have a larger varistor voltage and a smaller large current area discharge voltage ratio than a device to which any other rare earth element is added or a device to which no rare earth elements are added, but the small current area discharge voltage ratio increases and is deteriorated. However, if the added rare earth elements are limited to at least one element of Ho, Y, Er, and Yb, deterioration of the small current area discharge voltage ratio can be minimized although the device has a slightly higher small current area discharge voltage ratio than a device to which La, Ce, Pr, Nd, Sm is added or a device to which no rare earth elements are added.

Spacing obtained from the precipitation grains formed by adding at least one element of Ho, Y, Er, and Yb, dn, lies in the range of 2.86 Å$\leqq d_1 \leqq$2.88 Å, 1.85 Å$\leqq d_2 \leqq$1.86 Å, 1.78 Å$\leqq d_3 \leqq$1.79 Å, 1.57 Å$\leqq d_4 \leqq$1.58 Å, 1.55 Å$\leqq d_5 \leqq$1.56 Å. The spacing mentioned here is a spacing obtained according to the Bragg condition in the x-ray diffraction method, as described above.

In the voltage nonlinear resistor of the invention, preferably the spacing of precipitation grains is measured by the X-ray diffraction method at room temperature. The X-ray diffraction method can measure the crystalline spacing easily and with good accuracy.

Bismuth oxide having an average grain diameter of 1–10 μm normally is used as the bismuth oxide according to the invention. If the loads of the bismuth oxide are greater than 5 mol %, the opposite effect is shown to the grain growth suppression effect of zinc oxide grains; if the loads of the bismuth oxide are less than 0.1 mol %, a leakage current increases (the $V_L$ value lessens). Thus, preferably an adjustment is made so that a raw material of the voltage nonlinear resistor contains 0.1–5 mol %, particularly 0.2–2 mol %.

The voltage nonlinear resistor of the invention may contain antimony oxide having a nature increasing the $V_S$ value. Antimony oxide having an average grain diameter of 0.5–5 μm generally is used. If the loads of the antimony oxide are greater than 5 mol %, the varistor voltage is raised, but a large number of spinel grains of reactants with zinc oxide exist and the energization path is greatly limited, thus unevenness is increased and destruction easily occurs. On the other hand, if the loads of the antimony oxide are less than 0.5 mol %, the grain growth suppression effect of zinc oxide grains is not sufficiently produced. Thus, preferably an adjustment is made so that the raw material of the voltage nonlinear resistor contains 0.5–5 mol %, especially 0.75–2 mol %.

To improve voltage nonlinearity, the voltage nonlinear resistor of the invention may contain chromium oxide, nickel oxide, cobalt oxide, manganese oxide, and silicon oxide; preferably, the oxides each having an average grain diameter of 10 μm or less generally are used. To provide sufficient voltage nonlinearity, preferably the loads of each of the components are adjusted so that the raw material of the voltage nonlinear resistor contains 0.1 mol % or more, especially 0.2 mol % or more in terms of NiO, $CO_3O_4$, $Mn_3O_4$, $SiO_2$. However, if the loads are greater than 5 mol %, the amounts of a spinel phase, a pyrochroi phase (intermediate product of spinel phase generation reaction), and zinc silicate increase, thus the energy withstand amount tends to decrease and voltage nonlinearity tends to lower. Therefore, preferably an adjustment is made so that the raw material of the voltage nonlinear resistor contains 0.1–5 mol %, especially 0.2–2 mol %.

To lower electric resistance of zinc oxide grains and improve voltage nonlinearity, the voltage nonlinear resistor of the invention may contain 0.001–0.01 mol % aluminum nitrate. An aluminum ion, which has an ionic radius smaller than the ionic radius of $Zn^{2+}$, is dissolved solidly in Zno grain in the allowable range of lattice distortion and Zn of a divalent ion is replaced with the aluminum ion of a trivalent ion, whereby the inside of the crystal grains of ZnO is put into low resistance owing to the electronic effect. Resultantly, the large current area discharge voltage ratio is improved. Since mol % as $Al_2O_3$ is a half of mol % of aluminum nitrate $Al(NO_3)_3$, 0.0005–0.005 mol % becomes necessary as mol % of $Al_2O_3$.

To make the voltage nonlinear resistor of the invention play a role in putting bismuth oxide into a lower melting point, improving fluidity of the bismuth oxide, and efficiently reducing fine holes (bores) existing between lattices, etc., a 0.01–0.1 mol % boric acid may be contained in the raw material of the voltage nonlinear resistor.

Next, a manufacturing method of the voltage nonlinear resistor of the invention made of the above-described raw material will be discussed specifically. After the average grain diameter of the raw material is adjusted properly, for example, a polyvinyl alcohol water solution, etc., is used to form slurry, which then is dried and granulated with a sprayed drier, etc., to produce granules appropriate for molding. Single axis pressurization is applied to the produced granules under pressure of about 200–500 kgf/cm$^2$, for example, to produce a powder molded substance of a predetermined shape. To remove the binder (polyvinyl alcohol) from the powder molded substance, the powder molded substance is preheated at a temperature of about 600° C., then is sintered. In examples and comparative examples described later, data provided by measuring devices produced after sintering for five hours at 1150° C. is listed. The data is sintering conditions for a sintering reaction to proceed uniformly and sufficiently and making close-grained devices and can be set using an X-ray diffraction system, a thermogravimetric analysis system (TG), a thermomechanical analysis system(TMA), etc.

The voltage nonlinear resistor of the invention is mounted on the lightning arrester of the invention, whereby miniaturization and improvement in the protection property are enabled.

DESCRIPTION OF THE PREFERRED EMBODIMENT

EXAMPLES

Figure 1:
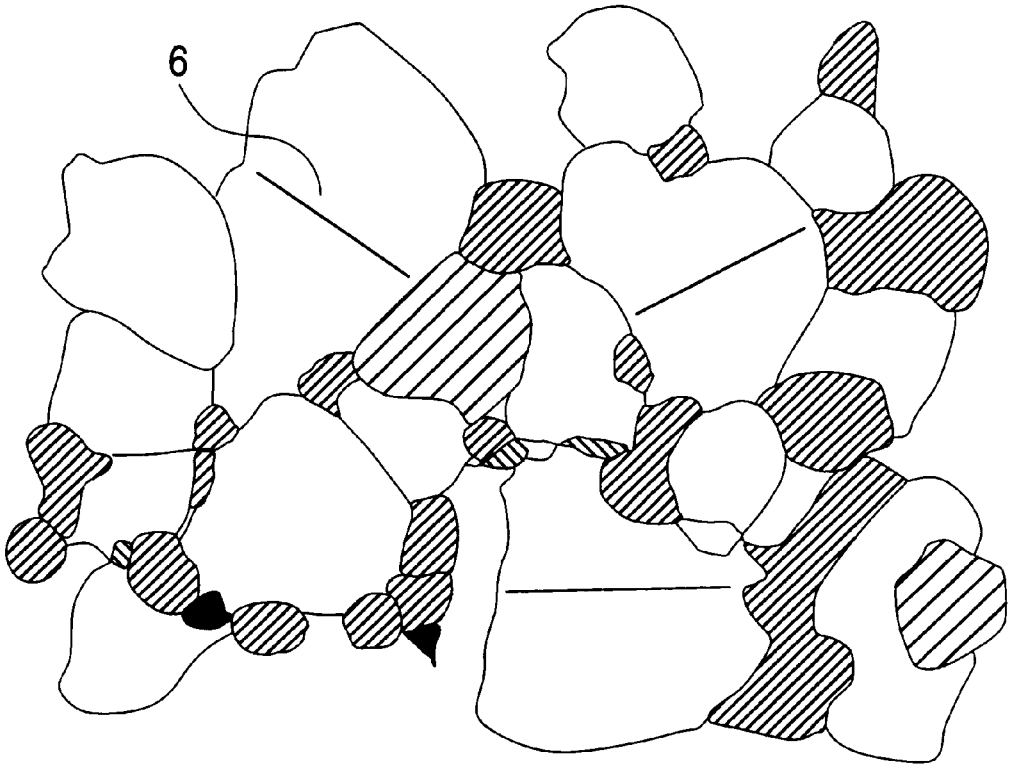
FIG. 1 is a schematic diagram to show the crystalline structure of a voltage nonlinear resistor according to an embodiment of the invention.

The voltage nonlinear resistor of the invention and a manufacturing method therefor will be discussed in more detail based on examples, but the invention is not limited to the examples.

Examples 1–12

Examples and comparison examples contain the following basic composition and manufacturing process: The bismuth oxide, chromium oxide, nickel oxide, cobalt oxide, manganese oxide, and silicon oxide contents are each 0.5 mol % and the antimony oxide content is 1.2 mol %. The boric acid content is adjusted to 0.08 mol %. Aluminum is added 0.004 mol % as a nitrate water solution. The remainder is zinc oxide.

$Eu_2O_3$ (example 1), $Gd_2O_3$ (example 2), $Tb_4O_7$ (example 3), $Dy_2O_3$ (example 4), $Ho_2O_3$ (example 5), $Y_2O_3$ (example 6), $Er_2O_3$ (example 7), $Tm_2O_3$ (example 8), $Yb_2O_3$ (example 9), or $Lu_2O_3$ (example 10) is added to the basic composition 0.5 mol % in terms of $R_2O_3$. For Eu and Lu, 0.5 mol % $La_2O_3$ is further added as examples 11 and 12. Each raw material is mixed and crushed with a bowl mill, then dried and granulated with a sprayed drier to produce granules. Single axis pressurization is applied to the produced granules under pressure of about 200–500 kgf/cm$^2$ to produce a powder molded substance 40 mm in diameter and 15 mm thick. To remove a binder (polyvinyl alcohol) from the produced powder molded substance, the powder molded substance is preheated for five hours at 600° C., then is sintered for five hours at 1150° C. to provide a voltage nonlinear resistor.

The provided voltage nonlinear resistor (shrunk to the shape about 32 mm in diameter by sintering) is ground and washed, then aluminum electrodes are formed and electric characteristics are measured. The discharge voltage ratio evaluation conditions are set as follows: The small current area discharge voltage ratio is evaluated as a value ($V_{1\,mA}/V_{10\,\mu A}$) resulting from dividing the interelectrode voltage across a device when the device is energized with 1 mA by the interelectrode voltage across the device when the device is energized with 10 $\mu$A, and the large current area discharge voltage ratio is evaluated as a value ($V_{2.5\,kA}/V_{1\,mA}$) resulting from dividing the interelectrode voltage across the device when the device is energized with 2.5 kA by the interelectrode voltage across the device when the device is energized with 1 mA. Table 1 lists the results.

TABLE 1

| | Rare earth elements | Added amount (mol %) | Varistor voltage ($V_{1ma}$/mm) | S.cu.are. dis.vol ratio | La.cu.are. dis.vol. ratio |
|---|---|---|---|---|---|
| Example 1 | $Eu_2O_3$ | 0.5 | 445 | 1.248 | 1.635 |
| Example 2 | $Gd_2O_3$ | 0.5 | 447 | 1.229 | 1.604 |
| Example 3 | $Tb_4O_7$ | 0.5 | 425 | 1.188 | 1.609 |
| Example 4 | $Dy_2O_3$ | 0.5 | 456 | 1.178 | 1.603 |
| Example 5 | $Ho_2O_3$ | 0.5 | 453 | 1.205 | 1.584 |
| Example 6 | $Y_2O_3$ | 0.5 | 463 | 1.198 | 1.576 |
| Example 7 | $Er_2O_3$ | 0.5 | 448 | 1.201 | 1.578 |
| Example 8 | $Tm_2O_3$ | 0.5 | 445 | 1.215 | 1.565 |
| Example 9 | $Yb_2O_3$ | 0.5 | 443 | 1.209 | 1.582 |
| Example 10 | $Lu_2O_3$ | 0.5 | 430 | 1.168 | 1.594 |
| example 11 | $Eu_2O_3$ + $La_2O_3$ | 0.5 (each) | 450 | 1.317 | 1.581 |
| example 12 | $Lu_2O_3$ + $La_2O_3$ | 0.5 (each) | 435 | 1.238 | 1.534 |
| c.exa. 1 | no add. | 0.5 | 323 | 1.083 | 1.743 |
| c.exa. 2 | $La_2O_3$ | 0.5 | 320 | 1.157 | 1.692 |
| c.exa. 3 | $CeO_4$ | 0.5 | 371 | 1.117 | 1.665 |
| c.exa. 4 | $Pr_6O_{11}$ | 0.5 | 332 | 1.144 | 1.658 |
| c.exa. 5 | $Nd_2O_3$ | 0.5 | 365 | 1.184 | 1.653 |
| c.exa. 6 | $Sm_2O_3$ | 0.5 | 409 | 1.161 | 1.645 |

c.exa.:comparative example
no add.:no addition
S.cu.ar.e.dis.vol.ratio:Small current area discharge voltage ratio($V_{1ma}/V_{10\mu A}$)
T.cu.are.dis.vol.ratio:large current area discharge voltage ratio($V_{2.5kA}/V_{1mA}$)
Added amount (mol %):Added amount(mol % in terms of $R_2O_3$)

As listed in the table, the varistor voltages of the devices to which Eu, Gd, Tb, Dy, Ho, Y, Er, Tm, Yb, and Lu are added (examples 1–12) increase as compared with those of the device to which no rare earth elements are added (comparative example 1) and the devices to which other rare earth elements La, Ce, Pr, Nd, and Sm are added (comparative examples 2–6); values almost close to 450 V/mm are obtained. The large current area discharge voltage ratio of each device can be lessened at least 0.1 or more by adding the rare earth elements.

The small current area discharge voltage ratios in examples 1 to 12 worsen as compared with those in comparative examples 1 to 6. However, when the rare earth elements Ho, Y, Er, and Yb are added, the small current area discharge voltage ratios are still high as compared with those in comparative examples 1–6, but are small as compared with those when Eu and Gd are added. When Tm, Lu, Tb, and Dy are added, the small current area discharge voltage ratios are also small. However, Tm and Lu are extremely expensive as compared with other rare earth element compounds and when Tb and Dy are added, the small current area discharge voltage ratios are small surely, but the large current area discharge voltage ratios are large, thus Tb and Dy are not desirable on practical use. Therefore, addition of at least one or more of Ho, Y, Er, and Yb is optimum for providing devices with a large varistor voltage and a small large current area discharge voltage ratio minimizing deterioration of the small current area discharge voltage ratio.

Further, to examine the features of the devices provided by adding the rare earth elements in the examples, the following experiment is carried out: If the rare earth elements in the examples are added, precipitation grains are formed in ZnO grains or on a grain boundary, as described above. Spacing obtained from the precipitation grains is measured by an X-ray diffraction method (XRD). Inexpensive $Y_2O_3$ that can be supplied stably (example 6) is used for the device. To check whether or not the X-ray diffraction peaks in example 6 obtained by measurement are actually caused by the precipitation grains, a substance of the same composition as the precipitation grains is manufactured artificially and spacing is measured by the X-ray diffraction method.

A manufacturing method of the substance of the same composition as the precipitation grains is as follows: The precipitation grains are made up of added rare earth elements (R)-bismuth-antimony-zinc-manganese, as described in the embodiment. When the precipitation grains are examined by analysis methods such as SEM (scanning electron microscope), EPMA (electron probe microanalysis), XRD (X-ray diffraction), and a transmission electron microscope (TEM) with EDS (energy dispersive X-ray spectroscopy), it is found that the element ratio is almost 13:3:13:8:1 (described in Japanese Patent Application No. Hei 8-101202). Yttrium oxide, bismuth oxide, antimony oxide, zinc oxide, and manganese oxide are mixed based on the analyzed element ratio and are sintered under the same conditions as in the examples. It is shown by the SEM and EPMA that the substance of the same composition as the precipitation grains thus prepared has all added elements existing uniformly rather than locally, namely, is of a single phase.

Figure 2:
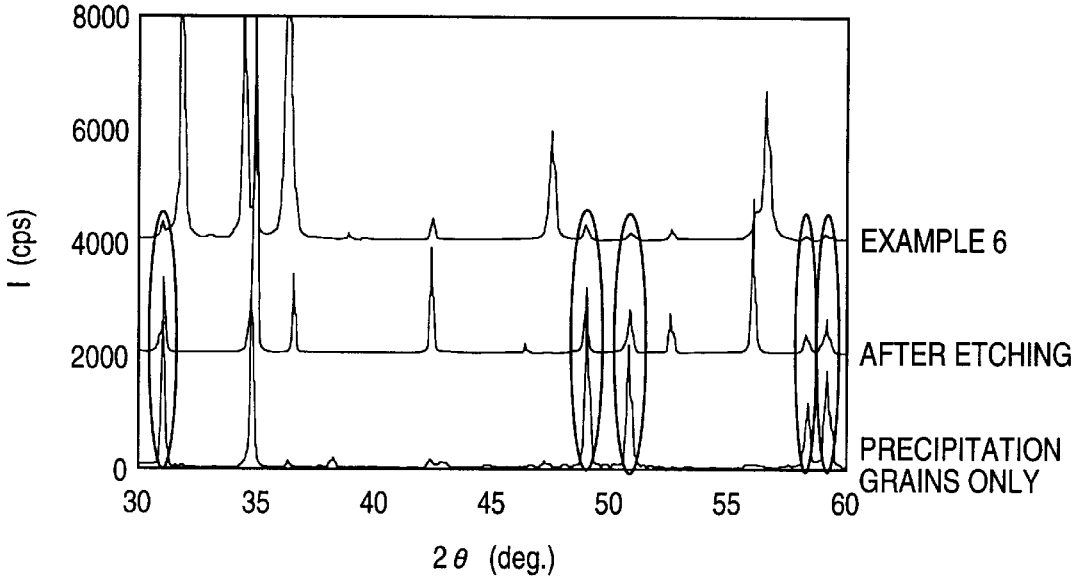
FIG. 2 is a chart to show X-ray diffraction patterns of the voltage nonlinear resistor according to the embodiment of the invention.

FIG. 2 shows X-ray diffraction patterns of the device of example 6 and a substance with only precipitation grains. In the figure, the vertical axis indicates diffraction X-ray strength I (cps) and the horizontal axis indicates angle θ which the incident X ray and diffraction X ray form with the crystal lattice face in the Bragg condition described in the embodiment. Here, the angle is indicated as 2θ (deg). As shown in the figure, the X-ray diffraction peaks of the device of example 6 also appear at the same places as the five X-ray diffraction peaks of the substance having the same composition as the precipitation grains (circled portions). Therefore, it can be checked that the five X-ray diffraction peaks of the device of example 6 are caused by the precipitation grains formed by adding $Y_2O_3$ to the device.

In FIG. 2, "after etching" is an X-ray diffraction pattern of the device of example 6 with ZnO of the main component of the device, which is immersed in a perchloric acid water solution for 24 hours and etched in order to more clarify the peaks caused by the precipitation grains existing in the device. ZnO is etched, whereby the places of the X-ray diffraction peaks caused by the precipitation grains can be made to clearly appear with no change.

It is also shown by an ED (electron diffraction) method that the precipitation grains in the device of example 7 are the same as those in the device of example 6.

Figure 3:
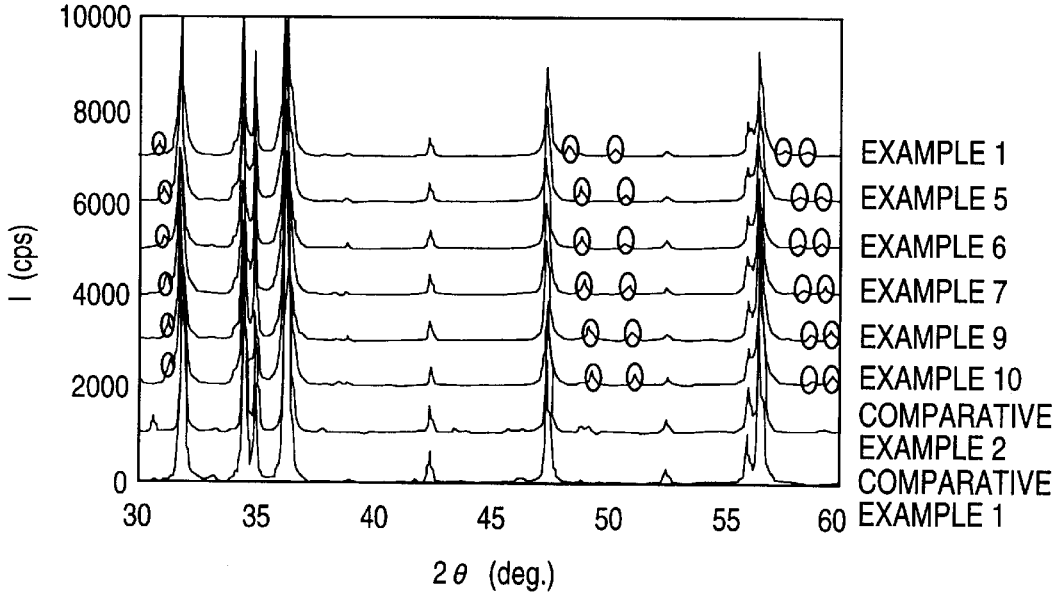
FIG. 3 is a chart to show X-ray diffraction patterns of the voltage nonlinear resistors according to the embodiment of the invention.

Next, the devices to which representative rare earth elements Eu (example 1), Ho (example 5), Er (example 7), Yb (example 9), and Lu (example 10) are added are analyzed by the X-ray diffraction method as described above. FIG. 3 is a chart to show X-ray diffraction patterns at this time. The X-ray diffraction pattern of the device of example 6 and X-ray diffraction patterns of comparative example 1 (with no rare earth elements added) and comparative example 2 (with La added) are also shown for comparison. As shown in the figure, it is seen that the X-ray diffraction peaks of the devices of examples 1, 5, 7, 9, and 10 also appear at the same five places as those of the device of example 6 and that precipitation grains are formed. In contrast, it is seen that X-ray diffraction peaks of the devices of comparative examples 1 and 2 are not detected at the same five places as those of the device of example 6 and that precipitation grains are not formed.

On an elaborate analysis of FIG. 3, it is seen that the X-ray diffraction peak caused by the precipitation grains moves to the high angle side little by little from example 1 to example 10. This is caused by the ionic radiuses of the added rare earth elements. Table 2 lists the ionic radiuses and spacings calculated from the X-ray diffraction patterns.

TABLE 2

| | Added rare earth element | Ionic radius | Spacing (Å) d1 | d2 | d3 | d4 | d5 |
|---|---|---|---|---|---|---|---|
| example 1 | Eu | 0.947 | 2.91 | 1.89 | 1.82 | 1.61 | 1.60 |
| example 2 | Gd | 0.938 | | | | | |
| example 3 | Tb | 0.923 | | | | | |
| example 4 | Dy | 0.912 | | | | | |
| example 5 | Ho | 0.901 | 2.88 | 1.86 | 1.79 | 1.58 | 1.56 |
| example 6 | Y | 0.9 | 2.87 | 1.86 | 1.79 | 1.58 | 1.56 |
| example 7 | Re | 0.89 | 2.85 | 1.85 | 1.79 | 1.58 | 1.56 |
| example 8 | Tm | 0.88 | | | | | |
| example 9 | Yb | 0.868 | 2.86 | 1.85 | 1.78 | 1.57 | 1.55 |
| example 10 | Lb | 0.861 | 2.85 | 1.83 | 1.77 | 1.56 | 1.54 |

As listed in the table 2, the smaller the ionic radius, the smaller the spacing. Thus, in FIG. 3, the X-ray diffraction peak moves to the high angle side from example 1 to which Eu having the largest ionic radius is added to example 10 to which Lu having the smallest ionic radius is added.

Figure 4:
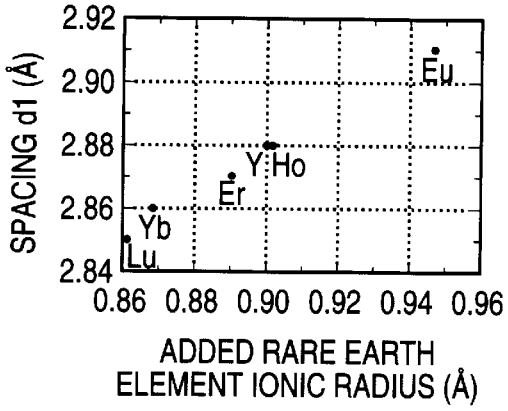
FIGS. 4(*a*)–4(*e*) are graphs to indicate the relationships between the spacings and the ionic radiuses of added elements to the voltage nonlinear resistors according to examples of the invention.
Figure 4:
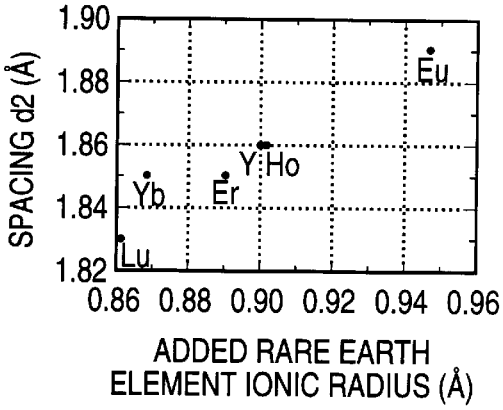
Figure 4:
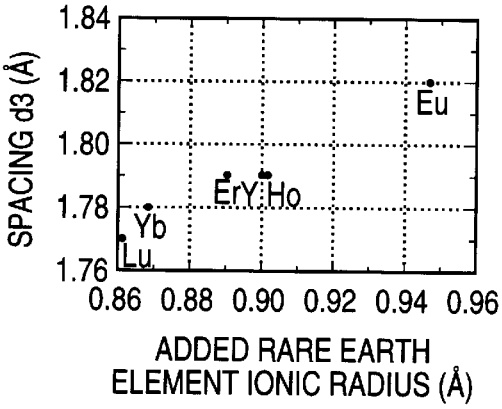
Figure 4:
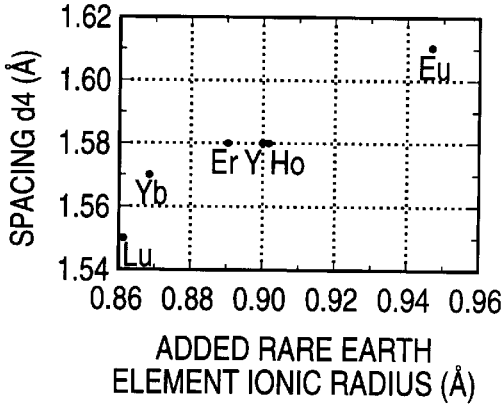
Figure 4:
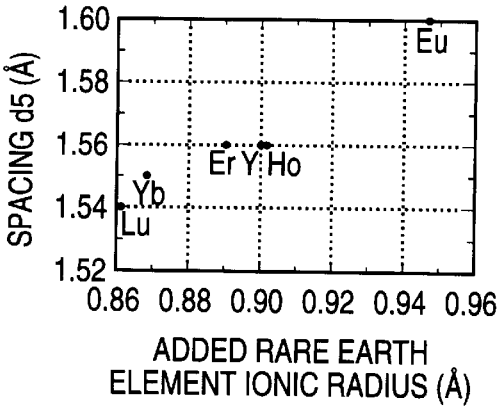

What values the spacings of the precipitation grains of the devices of examples 2, 3, 4, and 8 take can be guessed by using the ionic radiuses. FIG. 4 provides graphs to indicate the relationships between the spacings and the ionic radiuses in Table 2. As shown in FIG. 4, the spacing increases linearly with an increase in the ionic radius. Therefore, for examples 2, 3, 4, and 8, the spacing takes an intermediate value between the spacing provided by adding Lu having the smallest ionic radius among the rare earth elements forming precipitation grains as the minimum value and the spacing provided by adding Eu having the largest ionic radius as the maximum value. That is, if at least one or more elements of Eu, Gd, Tb, Dy, Ho, Y, Er, Tm, Yb, and Lu are added, the spacing dn (Å) provided from the precipitation grains lies in the range of 2.85 Å$\leqq d_1 \leqq$2.91 Å, 1.83 Å$\leqq d_2 \leqq$1.89 Å, 1.77 Å$\leqq d_3 \leqq$1.82 Å, 1.56 Å$\leqq d_4 \leqq$1.61 Å, 1.54 Å$\leqq d_5 \leqq$1.60 Å.

If the rare earth elements added are limited to at least one or more elements of Ho, Y, Er, and Yb, a device with a large varistor voltage and a small large current area discharge voltage ratio minimizing deterioration of the small current area discharge voltage ratio can be provided, as described above. Seeing the spacings listed in Table 2 for the rare earth elements Ho, Y, Er, and Yb, the spacings lie in the ranges of 2.86 Å$\leqq d_1 \leqq$2.88 Å, 1.85 Å$\leqq d_2 \leqq$1.86 Å, 1.78 Å$\leqq d_3 \leqq$1.79 Å, 1.57 Å$\leqq d_4 \leqq$1.58 Å, and 1.55 Å$\leqq d_5 \leqq$1.56 Å.

If the rare earth elements forming precipitation grains in examples 1 to 10 are added to the rare earth elements forming no precipitation grains in comparative examples 2 to 6, the spacings depending on the rare earth elements forming precipitation grains are provided so long as the rare earth elements forming precipitation grains are added.

In summary, if at least one rare earth element is added and at least one additional rare earth element is Eu, Gd, Tb, Dy, Ho, Y, Er, Tm, Yb, or Lu, precipitation grains are formed and the spacing $d_n$ (Å) provided from the precipitation grains lies in the range of 2.85 Å$\leqq d_1 \leqq$2.91 Å, 1.83 Å$\leqq d_2 \leqq$1.89 Å, 1.77 Å$\leqq d_3 \leqq$1.82 Å, 1.56 Å$\leqq d_4 \leqq$1.61 Å, 1.54 Å$\leqq d_5 \leqq$1.60 Å. The device having the condition can increase the varistor voltage and lessen the large current area discharge voltage ratio.

If the rare earth elements added are limited to at least one or more elements of Ho, Y, Er, and Yb, a device with a large varistor voltage and a small large current area discharge voltage ratio minimizing deterioration of the small current area discharge voltage ratio can be provided. The spacings provided from the precipitation grains lie in the ranges of 2.86 Å$\leqq d_1 \leqq$2.88 Å, 1.85 Å$\leqq d_2 \leqq$1.86 Å, 1.78 Å$\leqq d_3 \leqq$1.79 Å, 1.57 Å$\leqq d_4 \leqq$1.58 Å, and 1.55 Å$\leqq d_5 \leqq$1.56 Å.

The spacing measurement described in the examples is executed by the X-ray diffraction method (XRD) at a room temperature, but a method such as electron diffraction method (ED), reflection high energy electron spectroscopy, or low energy electron diffraction may be used.

Examples 13–17

The voltage nonlinear resistors described in the examples are mounted on voltage system lightning arresters, the lightning arresters can be miniaturized as compared with those on which the conventional voltage nonlinear resistors are mounted. Table 3 lists the results of applying the voltage nonlinear resistors to voltage system lightning arresters. The improvement contents of nonlinearity in the voltage nonlinear resistors described in the examples hold true for improvement in the protection property of lightning arresters.

Table 3 compares the conventional lightning arresters and the lightning arresters of the invention with respect to the outer dimensions and volume for each transmission system voltage. "Conventional" is a conventional lightning arrester using a conventional voltage nonlinear resistor and "the invention" is a lightening arrester using a voltage nonlinear resistor of the invention. The left side part under the column "outer dimensions" indicates the diameter and the right side part indicates the height.

TABLE 3

| | Transmission system | | Outer dimensions (mm) | Volume ratio |
|---|---|---|---|---|
| example 13 | 1000 kV | Conventional | ø1774 × 1800 | 1.0 |
| | | Present Iv. | ø932 × 1550 | 0.68 |
| example 14 | 500 kV | Conventional | ø932 × 1550 | 1.0 |
| | | Present Iv. | ø768 × 1800 | 0.5 |
| example 15 | 275 kV | Conventional | ø660 × 1000 | 1.0 |
| | | Present Iv. | ø1100 × 1635 | 0.41 |
| example 16 | 154 kV | Conventional | ø818 × 1600 | 1.0 |
| | | Present Iv. | ø542 × 1283 | 0.54 |
| example 17 | 66 kV | Conventional | ø542 × 1283 | 1.0 |
| | | Present Iv. | ø508 × 733 | 0.5 |

Present Iv.: Present Invention

As seen in the table 3, in every transmission system, the outer dimensions of the lightning arrester of the invention are miniaturized as compared with those of the conventional lightning arrester and assuming that the volume of the conventional lightning arrester is 1, that of the lightning arrester of the invention is remarkably miniaturized to 0.41–0.68.

Figure 5:
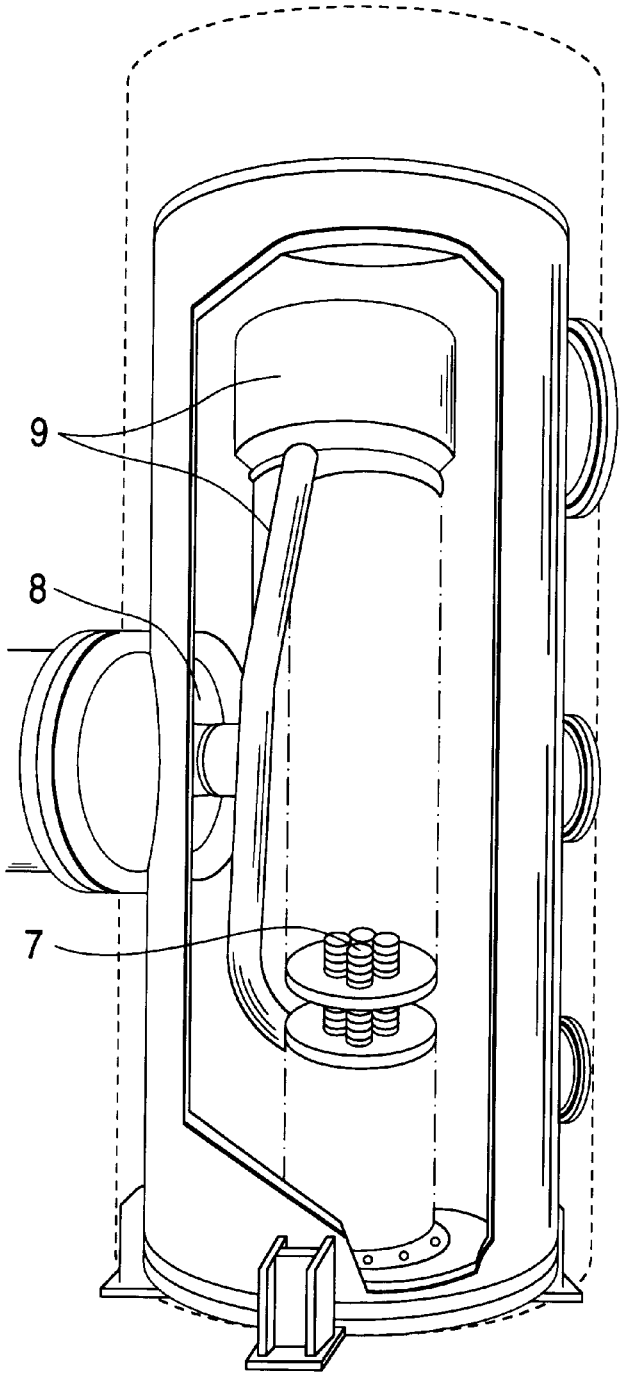
FIG. 5 is an illustration to show the structure of a lightning arrester according to an example of the invention.

FIG. 5 is an illustration to show the structure of a 1000-kv lightning arrester according to example 13 of the invention. As shown in the FIG. 5, the lightning arrester comprised is a voltage nonlinear resistor 7, an insulating spacer 8, and a shield 9. The dotted line indicates the outer dimensions of a conventional 1000-kV lightning arrester.

Figure 6:
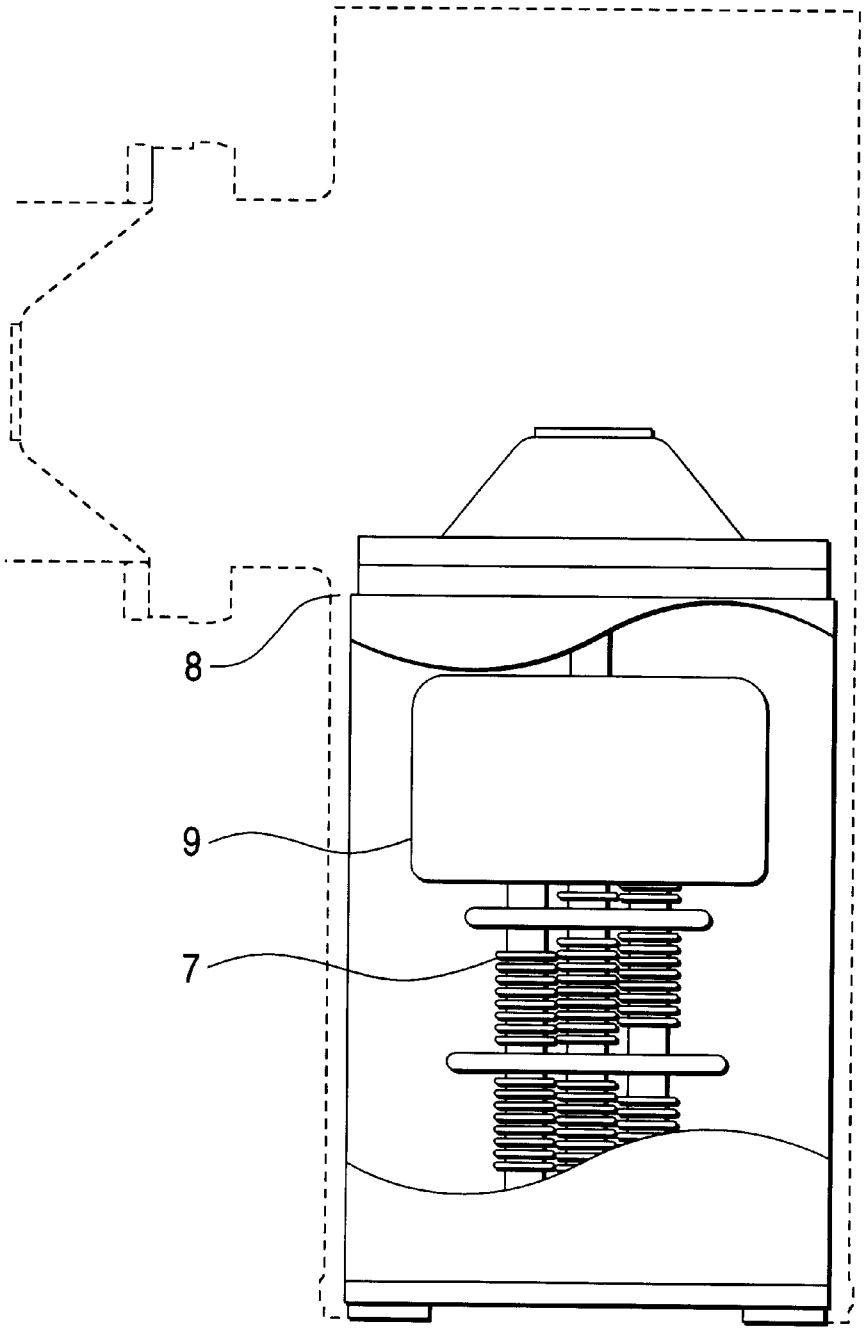
FIG. 6 is an illustration to show the structure of a lightning arrester according to an example of the invention.

FIG. 6 is an illustration to show the structure of a 500-kV lightning arrester according to example 14 of the invention. The dotted line indicates the outer dimensions of a conventional 500-kV lightning arrester.

Figure 7:
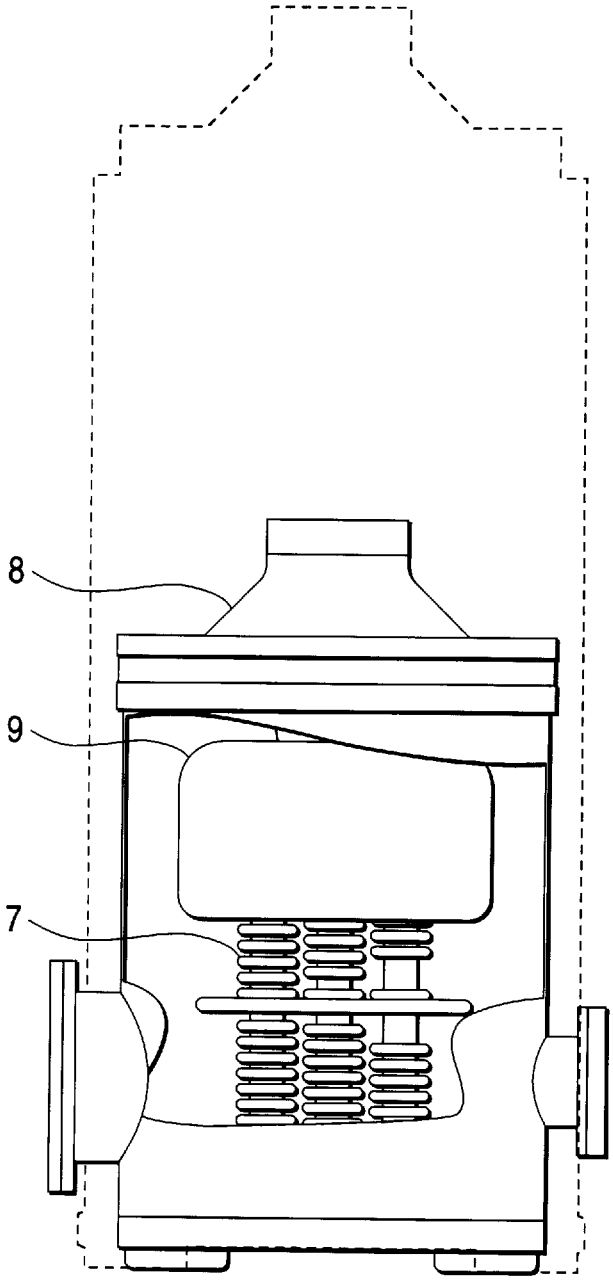
FIG. 7 is an illustration to show the structure of a lightning arrester according to an example of the invention.

FIG. 7 is an illustration to show the structure of a 275-kV lightning arrester according to example 15 of the invention. The dotted line indicates the outer dimensions of a conventional 275-kV lightning arrester.

Figure 8:
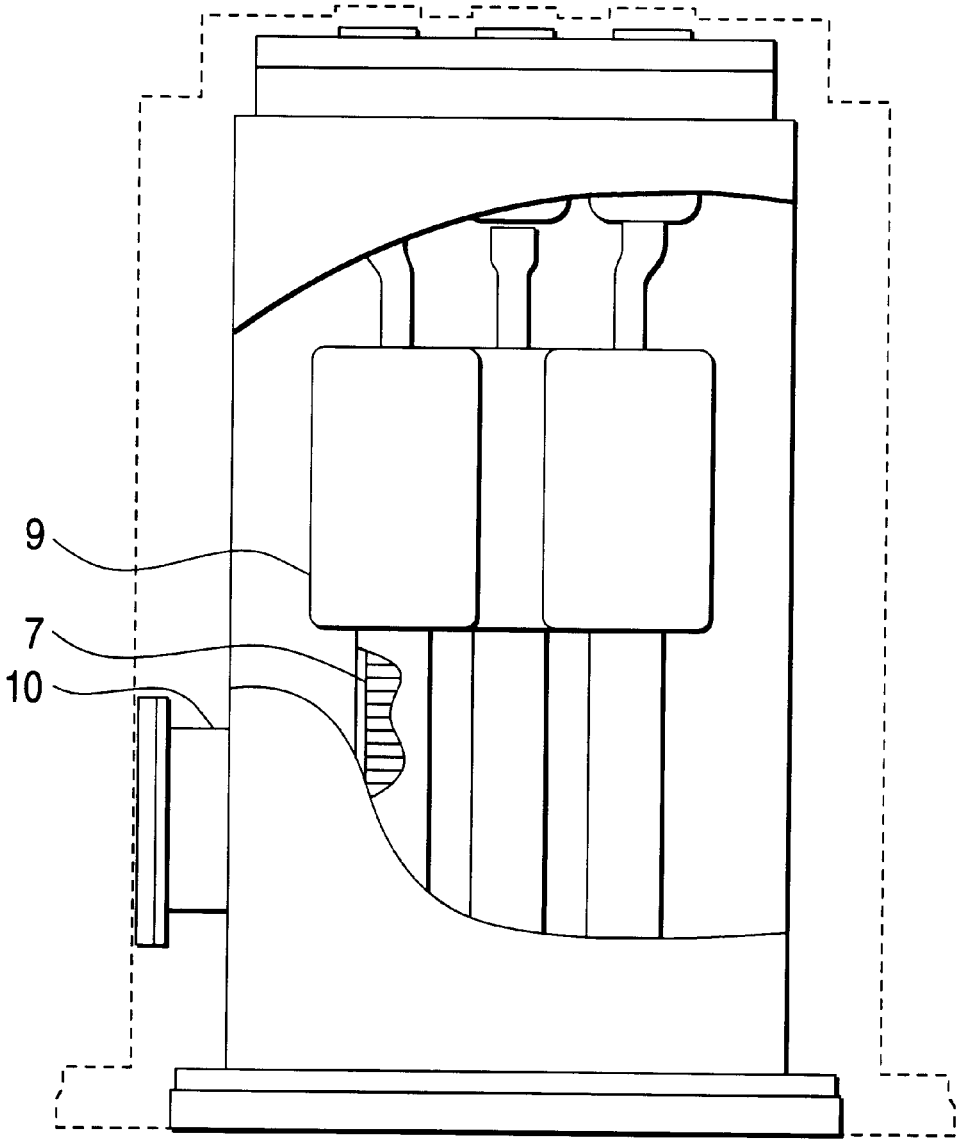
FIG. 8 is an illustration to show the structure of a lightning arrester according to an example of the invention.

FIG. 8 is an illustration to show the structure of a 154-kV lightning arrester according to example 16 of the invention. The dotted line indicates the outer dimensions of a conventional 154-kV lightning arrester. In the figure, numeral 10 is an insulating pipe.

Figure 9:
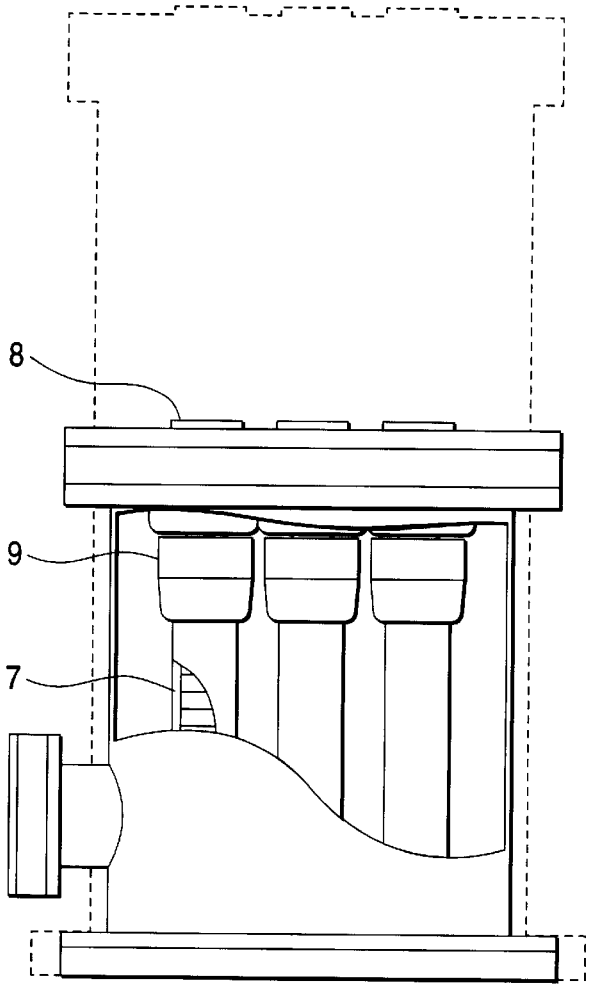
FIG. 9 is an illustration to show the structure of a lightning arrester according to an example of the invention.
Figure 10:
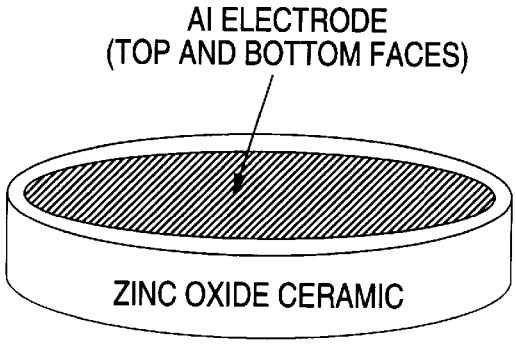
FIG. 10 is a schematic diagram to show the structure of a general zinc oxide varistor.
Figure 11:
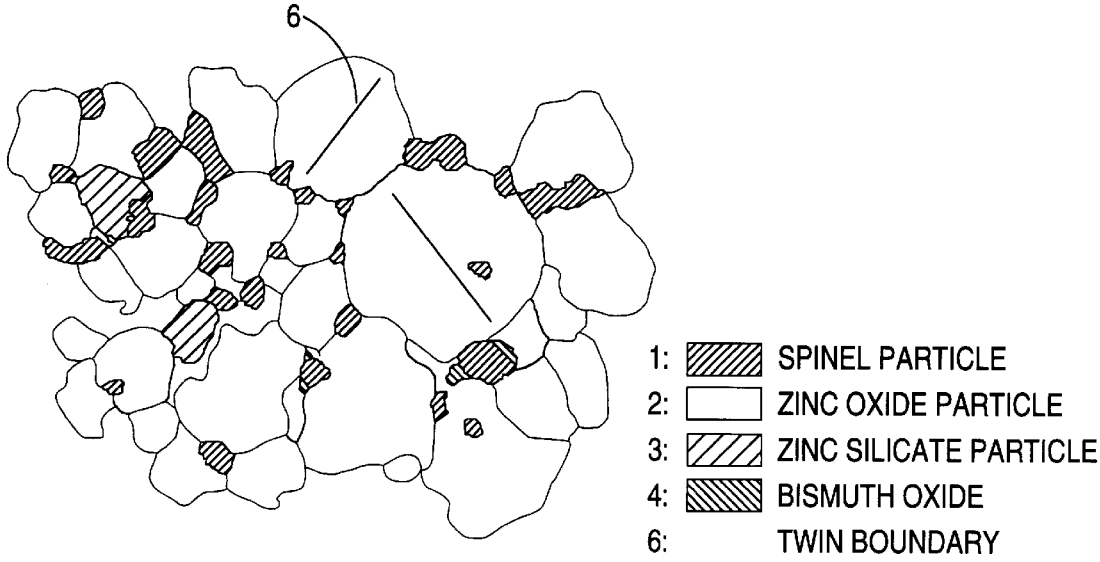
FIG. 11 is a schematic diagram to show the crystalline structure of a conventional voltage nonlinear resistor.
Figure 12:
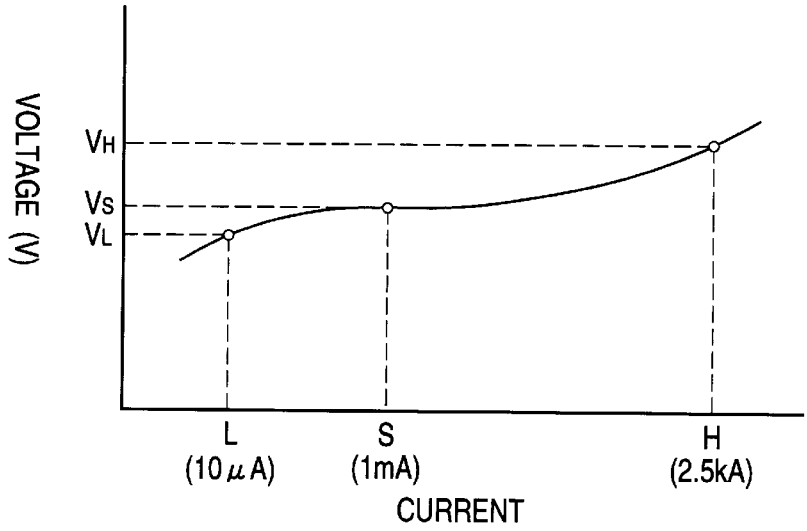
FIG. 12 is a volt-ampere plot to show the voltage-current characteristic of the general voltage nonlinear resistor in FIG. 11.

FIG. 9 is an illustration to show the structure of a 66/77-kV lightning arrester according to example 17 of the invention. The dotted line indicates the outer dimensions of a conventional 66/77-kV lightning arrester.

According to the first invention, there is provided a voltage nonlinear resistor of a sintered substance of a composite consisting essentially of zinc oxide and containing a plurality of rare earth elements, at least one of which is selected from the group consisting of Eu, Gd, Tb, Dy, Ho, Y, Er, Tm, Yb, and Lu, and Bi and Sb, wherein spacing dn (Å) provided from precipitation grains formed in zinc oxide grains or on a grain boundary lies in the range of 2.85 Å$\leqq d_1 \leqq$2.91 Å, 1.83 Å$\leqq d_2 \leqq$1.89 Å, 1.77 Å$\leqq d_3 \leqq$1.82 Å, 1.56 Å$\leqq d_4 \leqq$1.61 Å, 1.54 Å$\leqq d_5 \leqq$1.60 Å. Thus, the voltage nonlinear resistor with a large varistor voltage and a small large current area discharge voltage ratio can be provided.

According to the second invention, there is provided a voltage nonlinear resistor of a sintered substance of a composite consisting essentially of zinc oxide and containing at least one rare earth element selected from the group consisting of Eu, Gd, Tb, Dy, Ho, Y, Er, Tm, Yb, and Lu, and Bi and Sb, wherein spacing $d_n$ (Å) provided from precipitation grains formed in zinc oxide grains or on a grain boundary lies in the range of 2.85 Å$\leqq d_1 \leqq$2.91 Å, 1.83 Å$\leqq d_2 \leqq$1.89 Å, 1.77 Å$\leqq d_3 \leqq$1.82 Å, 1.56 Å$\leqq d_4 \leqq$1.61 Å, 1.54 Å$\leqq d_5 \leqq$1.60 Å. Thus, the voltage nonlinear resistor with a large varistor voltage and a small large current area discharge voltage ratio can be provided.

According to the third invention, there is provided a voltage nonlinear resistor of a sintered substance of a composite consisting essentially of zinc oxide and containing at least one rare earth element selected from the group consisting of Ho, Y, Er, and Yb, and Bi and Sb, wherein spacing dn (A) provided from precipitation grains formed in zinc oxide grains or on a grain boundary lies in the range of 2.86 Å$\leqq d_1 \leqq$2.88 Å, 1.85 Å$\leqq d_2 \leqq$1.86 Å, 1.78 Å$\leqq d_3 \leqq$1.79 Å, 1.57 Å$\leqq d_4 \leqq$1.58 Å, 1.55 Å$\leqq d_5 \leqq$1.56 Å. Thus, the voltage nonlinear resistor with a large varistor voltage and a small large current area discharge voltage ratio minimizing deterioration of the small current area discharge voltage ratio can be provided.

According to the forth invention, the spacing is measured by the X-ray diffraction method at a room temperature. Thus, the spacing of precipitation grains can be measured easily and with good accuracy.

According to the fifth invention, a voltage nonlinear resistor as claimed in any one of claims 1 to 4 is mounted, thus a small-sized lightning arrester with a good protection property can be provided.

What is claimed is:

1. A voltage nonlinear resistor of a sintered substance of a composite consisting essentially of zinc oxide and containing a plurality of rare earth elements, wherein at least one of which is selected from the group consisting of Eu, Gd, Tb, Dy, Ho, Y, Er, Tm, Yb, and Lu, and Bi and Sb, and at least one is selected from the group consisting of La, Ce, Pr, Nd, Sm, wherein the composite comprises precipitation grains formed in zinc oxide grains or on a grain boundary, and spacing $d_n$ (Å) between zinc oxide grains, provided from the precipitation grains, lies in the range of 2.85 Å$\leqq d_1 \leqq$2.91 Å, 1.83 Å$\leqq d_2 \leqq$1.89 Å, 1.77 Å$\leqq d_3 \leqq$1.82 Å, 1.56 Å$\leqq d_4 \leqq$1.61 Å, 1.54 Å$\leqq d_5 \leqq$1.60 Å, wherein n denotes a number given in the descending order of values of spacings obtained from the precipitation grains.

2. The voltage nonlinear resistor as claimed in claim 1, wherein the precipitation grains have tetragonal structure.

3. The voltage nonlinear resistor as claimed in claim 1, wherein the spacing is defined by the value measured by an X-ray diffraction method at a room temperature.

4. A lightning arrester, comprising a voltage nonlinear resistor as claimed in claim 1, wherein first and second electrodes are mounted to the voltage nonlinear resistor.

5. The voltage nonlinear resistor as set forth in claim 1, wherein one of the rare earth elements is La.

6. A voltage nonlinear resistor of a sintered substance of a composite consisting essentially of zinc oxide and containing at least one rare earth element selected from the group consisting of Ho, Y, Er, and Yb, and Bi and Sb, and the composite comprises precipitation grains formed in zinc oxide grains or on a grain boundary, and spacing $d_n$ (Å) between zinc oxide grains, provided from the precipitation grains, are in the range of 2.86 Å$\leqq d_1 \leqq$2.88 Å, 1.85 Å$\leqq d_2 \leqq$1.86 Å, 1.78 Å$\leqq d_3 \leqq$1.79 Å, 1.57 Å$\leqq d_4 \leqq$1.58 Å, 1.55 Å$\leqq d_5 \leqq$1.56 Å, wherein n denotes a number given in the descending order of values of spacings obtained from the precipitation grains.

7. The voltage nonlinear resistor as claimed in claim 6, wherein the precipitation grains have tetragonal structure.

8. The voltage nonlinear resistor as claimed in claim 6, wherein the spacing is defined by the value measured by an X-ray diffraction method at a room temperature.

9. A lightning arrester, comprising a voltage nonlinear resistor as claimed in claim 6, wherein first and second electrodes mounted to the voltage nonlinear resistor.

10. The voltage nonlinear resistor as claimed in claim 6, wherein the Bi is contained with bismuth oxide having an average grain diameter of 1–10 $\mu$m as a raw material.

11. The voltage nonlinear resistor as claimed in claim 6, wherein the Bi is contained 0.1–5 mol %.

12. The voltage nonlinear resistor as claimed in claim 6, wherein the Bi is contained 0.2–2 mol %.

13. A voltage nonlinear resistor manufacturing method comprising the steps of preparing a composite consisting essentially of zinc oxide and containing a plurality of rare earth elements, at least one of which is selected from the group consisting of Eu, Gd, Tb, Dy, Ho, Y, Er, Tm, Yb, and Lu, and Bi and Sb, and at least one is selected from the group consisting of La, Ce, Pr, Nd, Sm; and sintering the composite thereby spacing the $d_n$ (Å) between zinc oxide grains, provided from the precipitation grains formed in zinc oxide grains or on grain boundary lies in the range of 2.85 Å$\leqq d_1 \leqq$2.91 Å, 1.83 Å$\leqq d_2 \leqq$1.89 Å, 1.77 Å$\leqq d_3$Å$\leqq$1.82 Å, 1.56 Å$\leqq d_4 \leqq$1.61 Å, 1.54 Å$\leqq d_5 \leqq$1.60 Å after sintering, wherein n denotes a number given in descending order of values of spacings obtained from the precipitation grains.

* * * * *